US009555861B2

(12) United States Patent
Singh et al.

(10) Patent No.: US 9,555,861 B2
(45) Date of Patent: Jan. 31, 2017

(54) MOORING LINE RESTRAINER

(71) Applicants: Manu Singh, Gurgaon (IN); Yash Pal Singh, Gurgaon (IN)

(72) Inventors: Manu Singh, Gurgaon (IN); Yash Pal Singh, Gurgaon (IN)

( * ) Notice: Subject to any disclaimer, the term of this patent is extended or adjusted under 35 U.S.C. 154(b) by 0 days.

(21) Appl. No.: 14/431,532

(22) PCT Filed: Nov. 30, 2012

(86) PCT No.: PCT/IN2012/000780
§ 371 (c)(1),
(2) Date: Mar. 26, 2015

(87) PCT Pub. No.: WO2014/049600
PCT Pub. Date: Apr. 3, 2014

(65) Prior Publication Data

US 2015/0259040 A1 Sep. 17, 2015

(30) Foreign Application Priority Data

Sep. 27, 2012 (IN) ..... 3017/DEL/2012

(51) Int. Cl.
*B63B 21/04* (2006.01)
*B63B 21/10* (2006.01)
*B63B 21/00* (2006.01)

(52) U.S. Cl.
CPC ..... *B63B 21/04* (2013.01); *B63B 21/10* (2013.01); *B63B 2021/005* (2013.01); *B63B 2231/30* (2013.01)

(58) Field of Classification Search
CPC ..... B63B 21/04; B63B 2021/005
(Continued)

(56) References Cited

U.S. PATENT DOCUMENTS 2,642,640 A * 6/1953 Mills ..... D06F 53/04 24/130
3,724,034 A * 4/1973 Osano ..... A01K 91/04 24/131 C (Continued)

FOREIGN PATENT DOCUMENTS

AU WO 0131227 A1 * 5/2001 ..... B63B 21/04
WO 0131227 A1 5/2001

OTHER PUBLICATIONS

UK P&I Club, Understanding Mooring Incidents, Loss Prevention News, Jan. 2009.

*Primary Examiner* — Lars A Olson
*Assistant Examiner* — Jovon Hayes
(74) *Attorney, Agent, or Firm* — The Webb Law Firm

(57) ABSTRACT

Provided herein is a Mooring Line Restrainer capable of withstanding the whiplash from the impact of a snapped mooring line, and including a contoured Restraining Member shaped to engage and restrain snapped mooring lines and incorporating a single or multi-turn spring, mounted on a framework attached to one or more support bases. At least one of the support bases is a magnetic holding device adequate for different sizes of mooring lines, for securely and strongly fixing the Mooring Line Restrainers on the deck of a ship at appropriate positions along and on either sides of the mooring lines as per a mooring layout plan. The support bases have provisions for interlinking the plurality of adjacent or alternate Mooring Line Restrainers for forming a strong structure around the mooring lines for confining and restraining any snapped mooring lines within a narrow zone around their pre-snapped positions on the ship's deck.

10 Claims, 14 Drawing Sheets

Figure 1A:
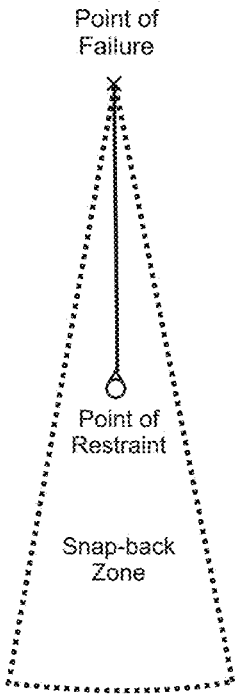

(58) Field of Classification Search
USPC ..... 114/199
See application file for complete search history.

(56) References Cited

U.S. PATENT DOCUMENTS

| | | | | | |
|---|---|---|---|---|---|
| 4,178,661 | A * | 12/1979 | Klein | F16G 11/00 | 24/130 |
| 4,281,439 | A * | 8/1981 | Klein | F16G 11/00 | 119/769 |
| 5,630,257 | A * | 5/1997 | Brody | B60P 7/0823 | 24/130 |
| 5,682,652 | A * | 11/1997 | Brody | B60P 7/0823 | 24/130 |
| 7,444,719 | B2 * | 11/2008 | Robinson | B63B 21/08 | 24/129 C |
| 7,594,923 | B2 * | 9/2009 | Fallin | A61B 17/0401 | 24/129 R |
| 2015/0259040 | A1 * | 9/2015 | Manu | B63B 21/04 | 114/199 |

* cited by examiner

MOORING LINE RESTRAINER

CROSS-REFERENCE TO RELATED APPLICATIONS

This application is the United States national phase of International Application No. PCT/IN2012/000780 filed Nov. 30, 2012, and claims priority to Indian Patent Application No. 3017/DEL/2012 filed Sep. 27, 2012, the disclosures of which are hereby incorporated in their entirety by reference.

BACKGROUND OF THE INVENTION

Field of Invention

The present invention relates to a mooring line restrainer for restricting the area on the deck of a ship of the snap-back zone of a snapped high tension mooring line in order to eliminate or at least reduce injury to ship's personnel and equipment. More particularly, the invention relates to development of novel structural frameworks which can be setup by positioning and linking the mooring line restrainers around the mooring lines on the deck of a ship for restraining any snapped mooring line to a much smaller area.

Description of Related Art

A Mooring refers to any permanent structure to which a vessel may be secured. A ship is secured to a mooring through mooring lines to forestall free movement of the ship on the water. An anchor mooring fixes a vessel's position relative to a point on the bottom of a waterway without connecting the vessel to shore. A Mooring Operation involves laying mooring lines to remote off board locations like anchors, quays, wharfs, tugs, other ships or mooring buoys for securing a ship in a given position.

It is, a known fact that snapping of lines constitutes one of the principal hazards associated with mooring operations. The lines can and do part occasionally. Numerous accidents, many of them fatal, have been regularly reported over the years. When lines under stress break suddenly, the "free end tends to 'whip' or 'oscillate' violently" and hit anybody or anything within their path with tremendous force. A snapped mooring line recoils in an area designated as the "Snap-back Zone". Statistical evidence shows that in 53 percent of all cases of personal injuries arising from mooring incidents, ropes (wire or fibre) have parted under load and personnel within 'snap-back zones' have been hit. In 42 percent of cases, ropes/wires have not parted, but injuries have resulted from ropes jumping/slipping off drum-ends or bitts, or personnel being caught or 'dragged' by ropes, fixtures coming off mountings and from other causes [UK P&I Club's Loss Prevention Bulletin January 2009].

Qualified seafarers are aware of the fact that a snapback zone exists when a mooring line is under tension, and the mooring crew are expected to take this into account when they are working mooring lines on deck. It is possible to roughly estimate the limits of these 'snap-back' zones and if they are highlighted on the deck, the mooring crew can avoid standing inside or close to these danger areas. Painting these areas also helps supervising officers instruct crew to keep clear when lines are coming under tension. Highlighting mooring line snap-back zones ensures that crew can visibly see the danger areas without having to purposely think about them while working.

The shapes and limits of these danger zones have been roughly estimated, and as stated earlier as a precaution these are recommended to be marked on the deck, and the mooring crews are advised not to stand inside or close to these areas. But very often the mooring crew are required to lay more than one line within the area or because of some other operational considerations it may not be always practicable to avoid the snap-back zones. Mooring areas in many cases may also contain several trip and obstruction hazards, and highlighting these is a good starting point.

However, in several cases the number and arrangement of mooring lines can even create several overlapping snap-back zones, and it would be difficult for the mooring crew to avoid these dangerous areas. It is also widely recognized that the estimation of the exact size of these snap-back zones is a very complex analytical problem, and cannot be determined with any reasonable degree of assurance, and thus the mooring crew, is continuously exposed to danger.

Numerous accidents, many of them fatal, have involved seamen being caught in bights of or getting entangled with mooring ropes in motion and being dragged into mooring equipment or fittings. Mooring operations are hazardous, mainly because of the great loads the mooring lines are subjected to, which means that they are likely to part with little warning and great force. When a line breaks or is suddenly released under tension, it will travel back probably within a narrow cone around a straight line, striking anybody or anything in its path. If the line leads around a roller or a lead, then it may potentially whip around in a wider arc.

However, since it is known that the actual dimension of such areas is difficult to determine, and may potentially extend over an area larger than the limits normally shown in various official safety manuals. This is because there are too many factors like material, age/condition, and length of line deployed, the mode of failure, and the angle of line that influence the behavior of a snapped mooring line. Therefore, the dynamics of a snapped mooring line being very complex is not amenable for analysis by simple mathematical models. A snapped line behaves in a very unpredictable chaotic manner.

In view of this, the practice of reliance on the shape and size of the snap-back zones determined on the basis of unsound reasoning only provides limited safety in many situations. In reality the incorrectly marked snap-back zones may even provide a false sense of safety and security to the mooring crew.

SUMMARY OF THE INVENTION

At present, there is no specific structural provision for ensuring enhanced safety for personnel engaged in mooring operations. Therefore, it is felt that there is a need to develop and design a novel system for restraining any snapped line to a much smaller area by installing appropriate frameworks, thus substantially promoting the safety of mooring crew. The instant invention, MOORING LINE RESTRAINER, aims to restrict the extent of the danger zone and also eliminate the uncertainty in ascertaining the limits of the snap-back zones.

An object of the invention is to develop a mooring line restraining devices for restricting the area of the snap-back zone of a snapped high tension mooring line on the deck of a ship.

Another object of this invention is to provide specific structural provision for ensuring enhanced safety for personnel engaged in mooring operations.

An additional object of this invention is to position a novel structural framework in place for restraining and confining any snapped mooring line on board a ship to a much smaller area.

Yet another object of this invention is to devise a specially designed mooring line restraining device capable of (a) restricting the extent of the danger zone and (b) minimizing the uncertainty in ascertaining the limits of the snap-back zones.

A further object of this invention is to develop a novel mooring line restraining device adapted to be interlinked with other similar devices to be placed strategically on the deck of a ship.

An additional object of this invention is to propose a restraining device, comprising at least one restraining member adapted to be located on the deck of a ship which is being contoured to be engaged by a mooring line on snapping.

A further additional object of the invention is to considerably reduce the size of the snap-back zones thereby greatly extending the safe working area on the decks for the members of the mooring crew.

Yet another additional object of the invention is to develop a contoured restraining device to be mounted on a framework supported on one or more magnetic holding device(s) for securely anchoring it to a desired location on the ship's deck.

According to the invention, there is provided a Mooring Line Restrainer capable of withstanding whiplash from the impact of a snapped mooring line, and comprising a contoured Restraining Member shaped to engage and restrain snapped mooring lines and incorporating a single or multi-turn spring, mounted on a framework attached to one or more support bases. At least one of the support bases is a magnetic holding device of appropriate type and size with sufficient holding strength adequate for different sizes of mooring lines for securely and strongly fixing the Mooring Line Restrainers on the deck of a ship at appropriate positions along and on either sides of the mooring lines as per its mooring layout plan. The support bases have provisions for interlinking the plurality of adjacent or alternate Mooring Line Restrainers for forming a strong structure around the mooring lines for confining and restraining any snapped mooring lines within a narrow zone around their pre-snapped positions on the ship's deck thereby substantially reducing the effective snap-back zone and consequently increase a safe working area on a ship's deck during mooring and towing operations.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of disclosure. Accordingly, other objects and a full understanding of the invention and the detailed description of the preferred embodiment in addition to the scope of the invention are to be defined by the claims taken in conjunction with the accompanying drawings.

BRIEF DESCRIPTION OF ACCOMPANYING DRAWINGS

Further objects and advantages of this invention will be more apparent from the ensuing description when read in conjunction with the accompanying drawings wherein:

FIG. 1(*a*) and

Figure 1B:
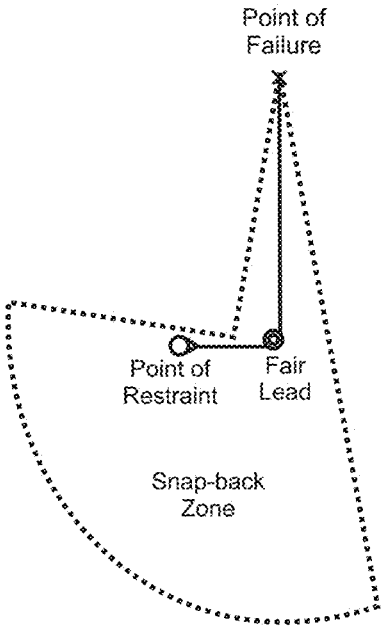

FIG. 1*b*): The snap-back zones.

Figure 1C:
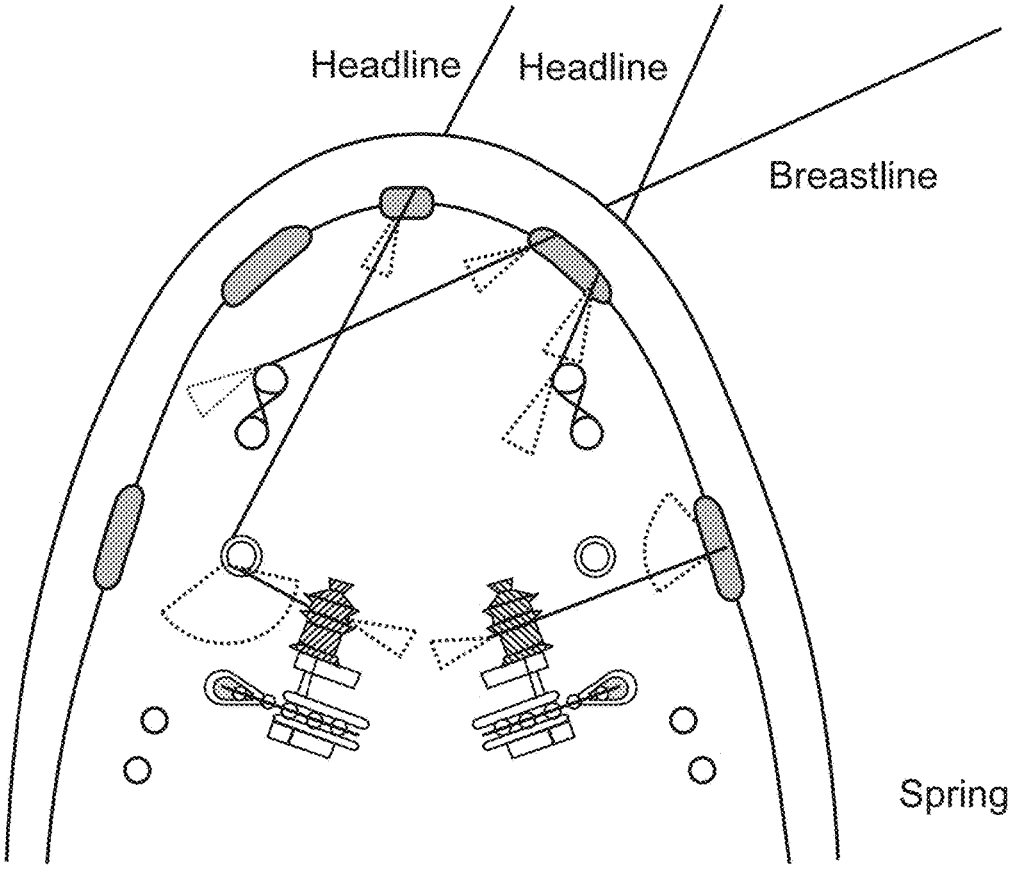
Figure 2A:
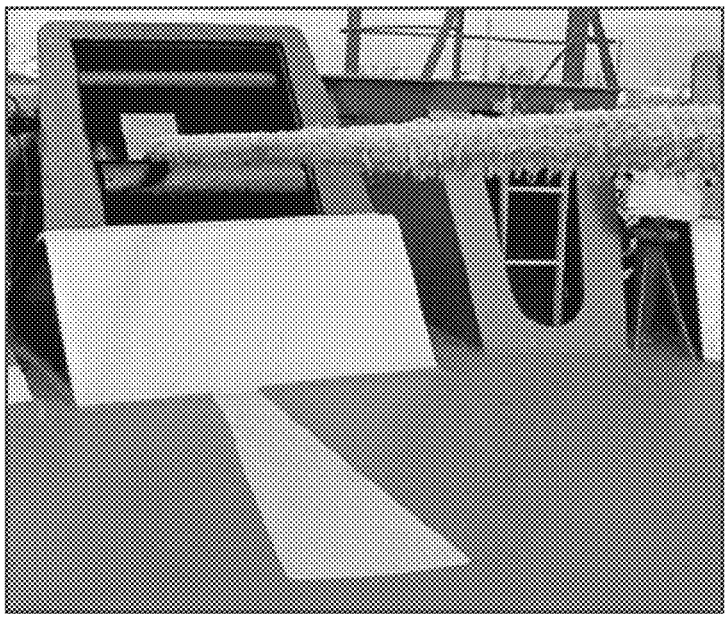
Figure 2B:
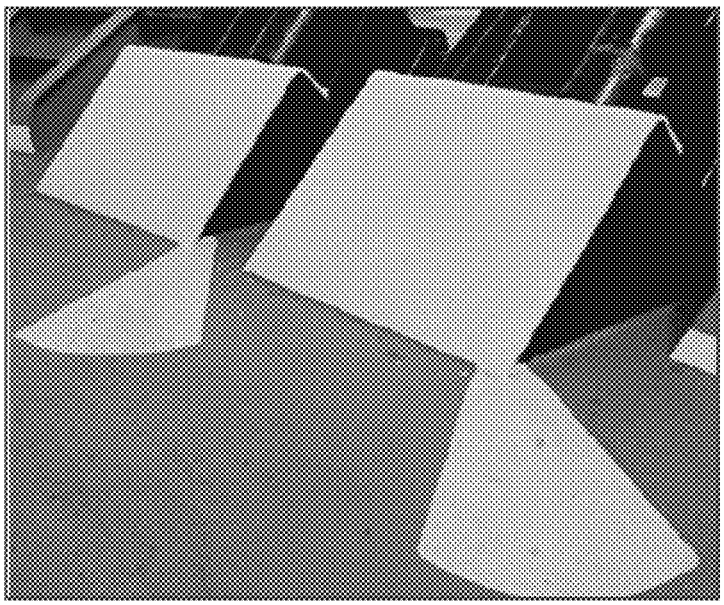
Figure 2C:
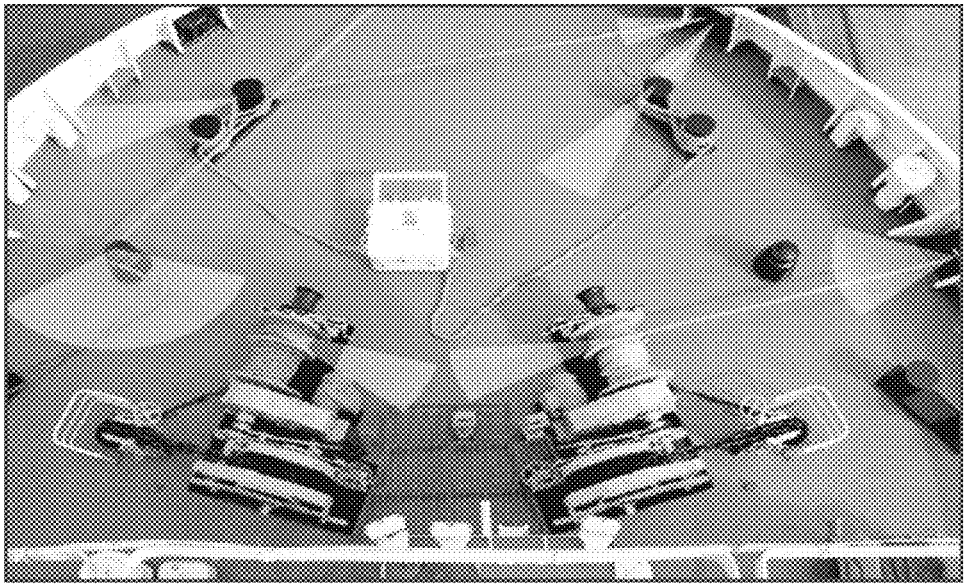
Figure 2D:
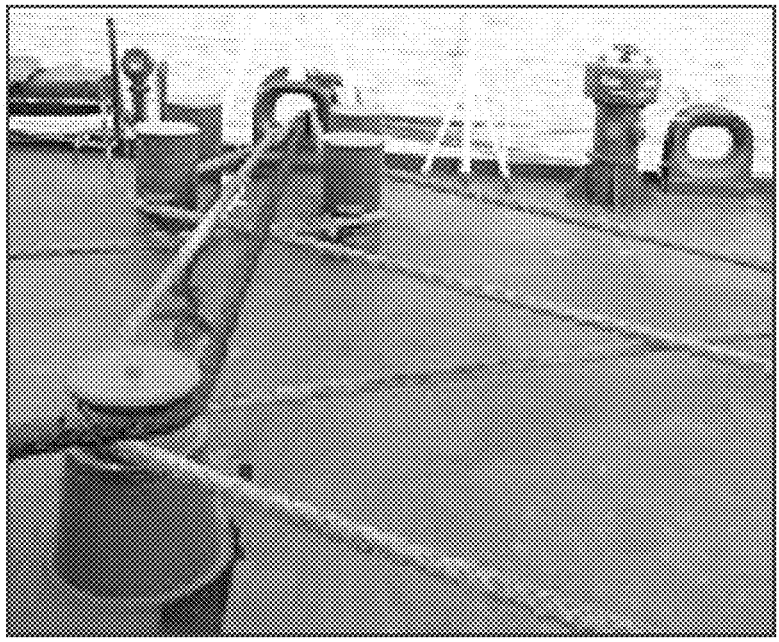

FIG. 1(*c*): A scheme of marking snap-back zones on the deck of a ship.

FIG. 2(*a*) and

FIG. 2(*b*): The actual marking of snap-back zones on the deck of a ship.

FIG. 2(*c*): A typical ship deck with various fittings.

FIG. 2(*d*): A ship deck crowded by a number of mooring lines.

FIG. 3(*a*) to

Figure 3A:
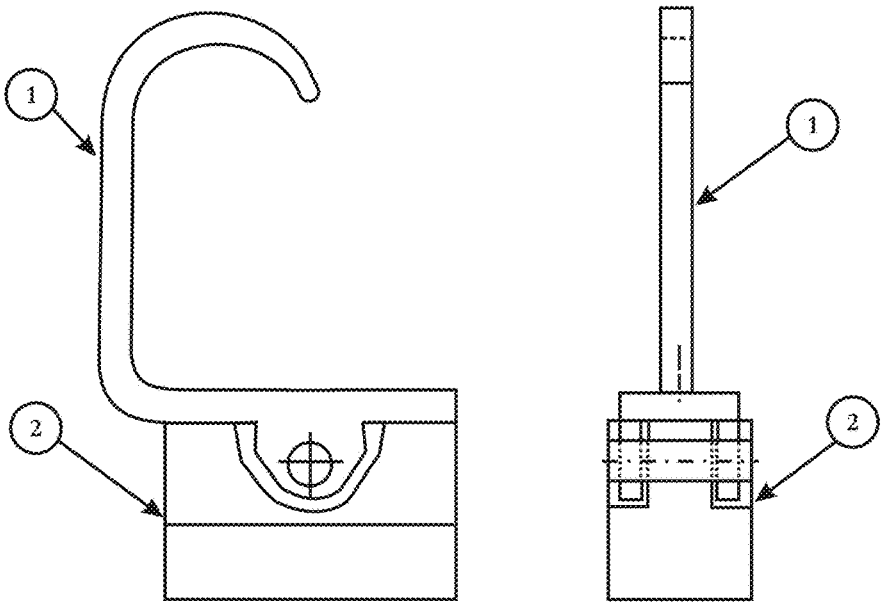
Figure 3:
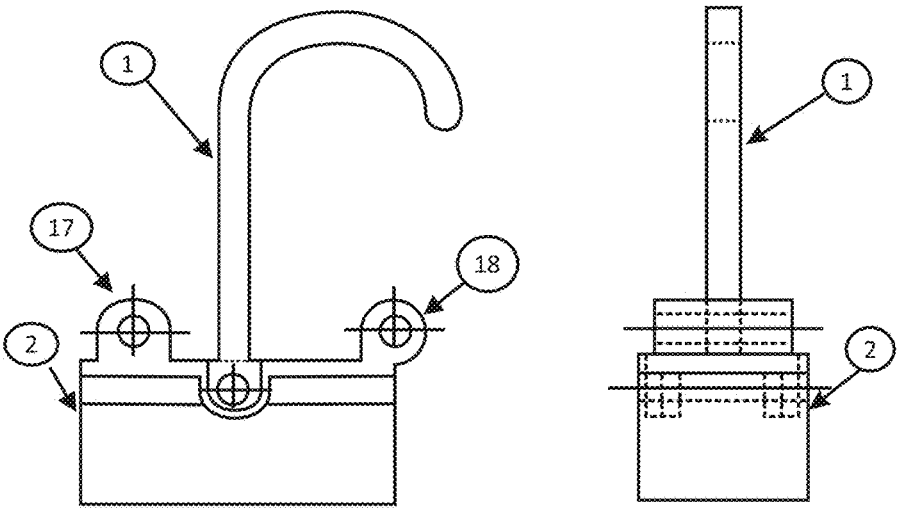
Figure 3B:
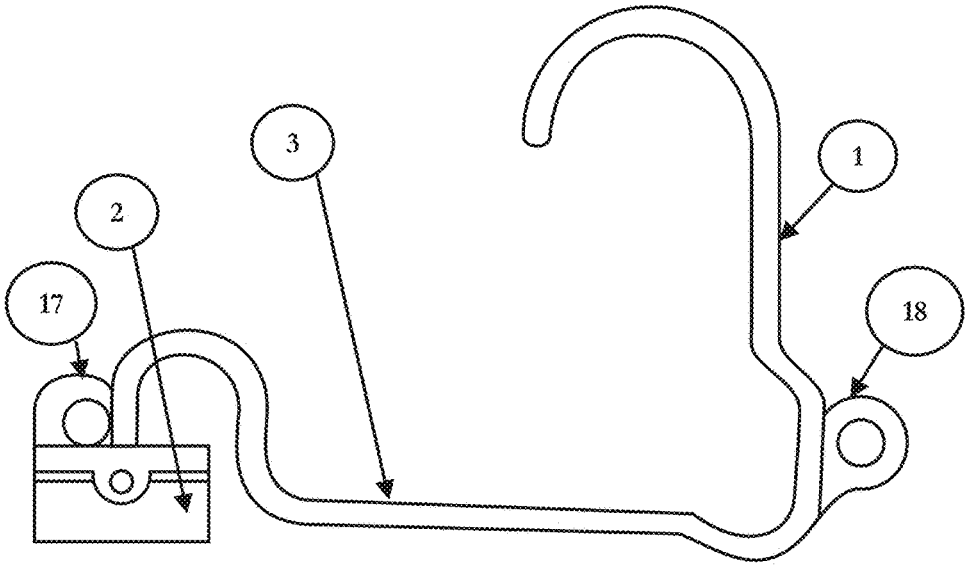
Figure 3C:
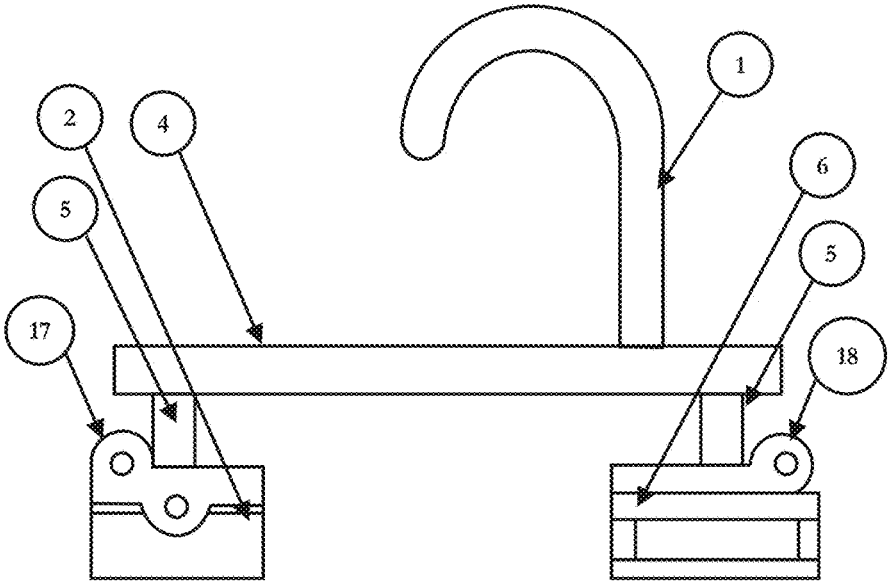
Figure 3D:
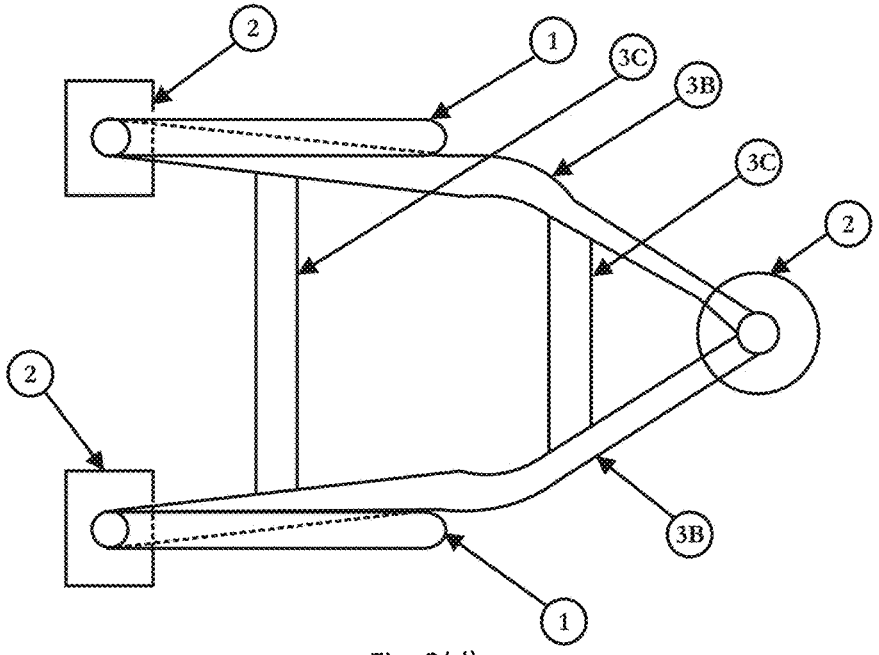
Figure 3E:
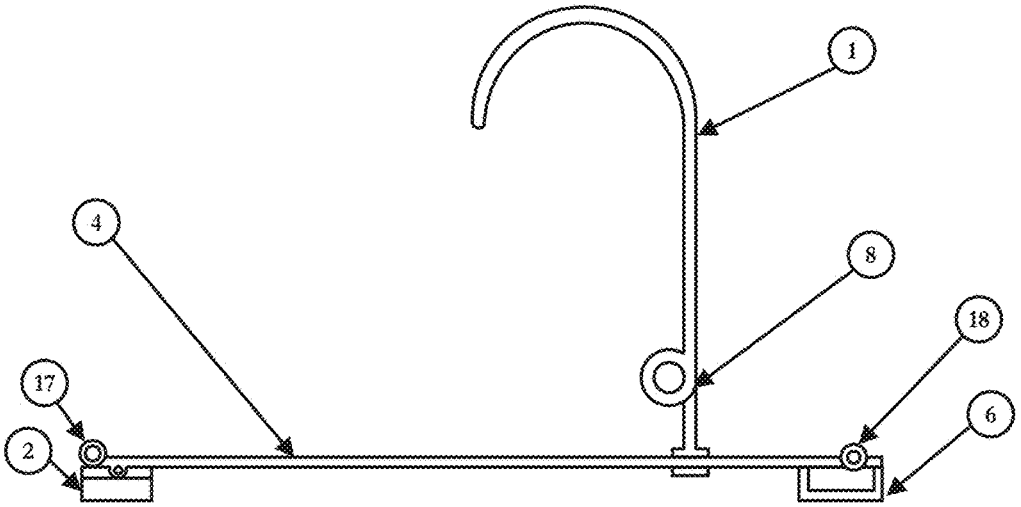
Figure 4A:
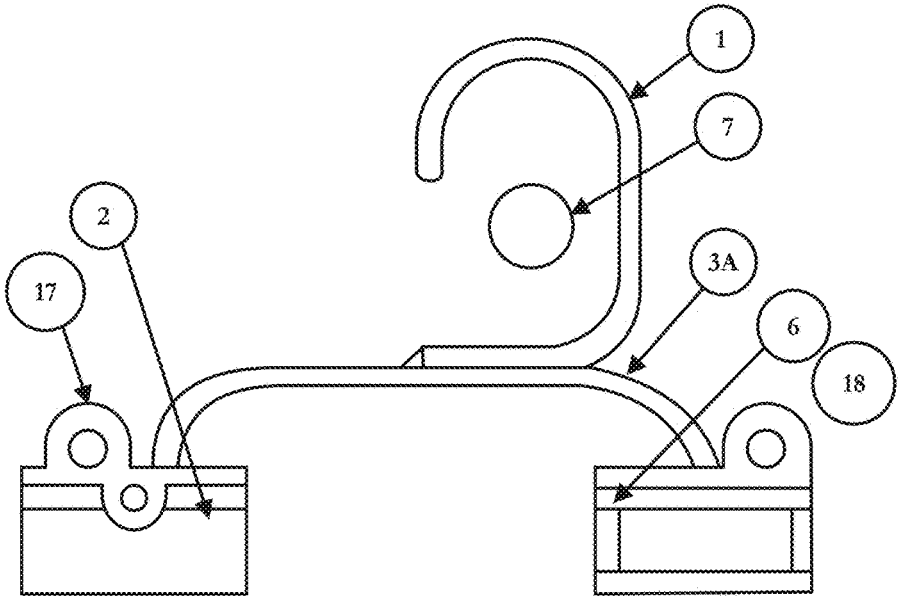
Figure 4B:
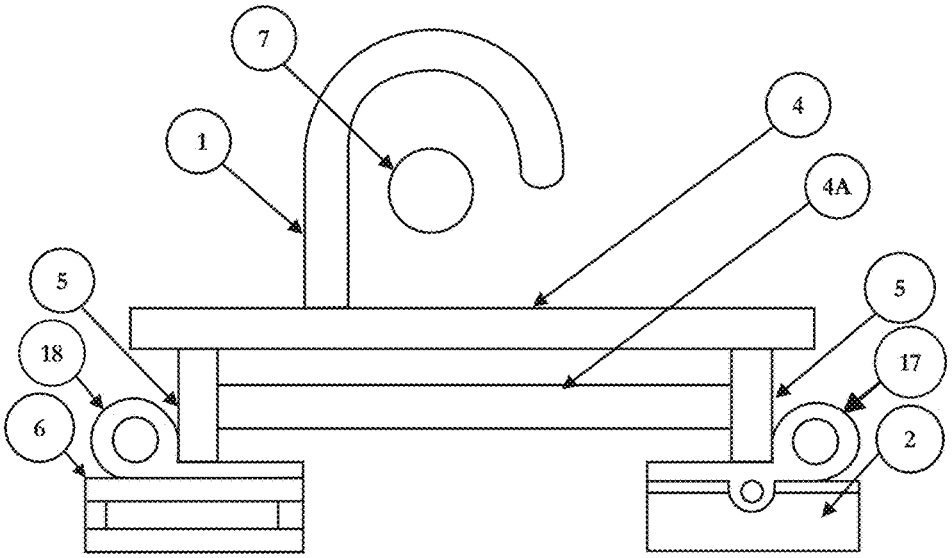
Figure 4C:
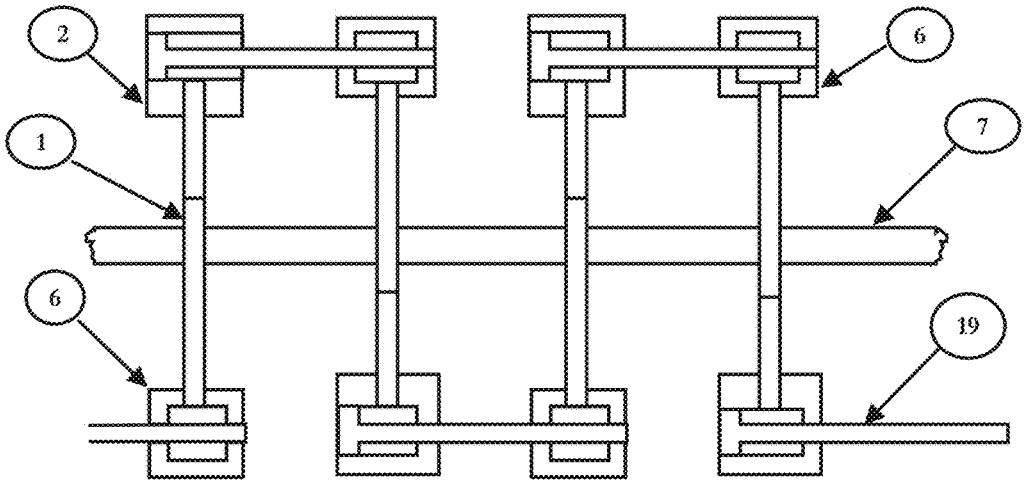
Figure 4D:
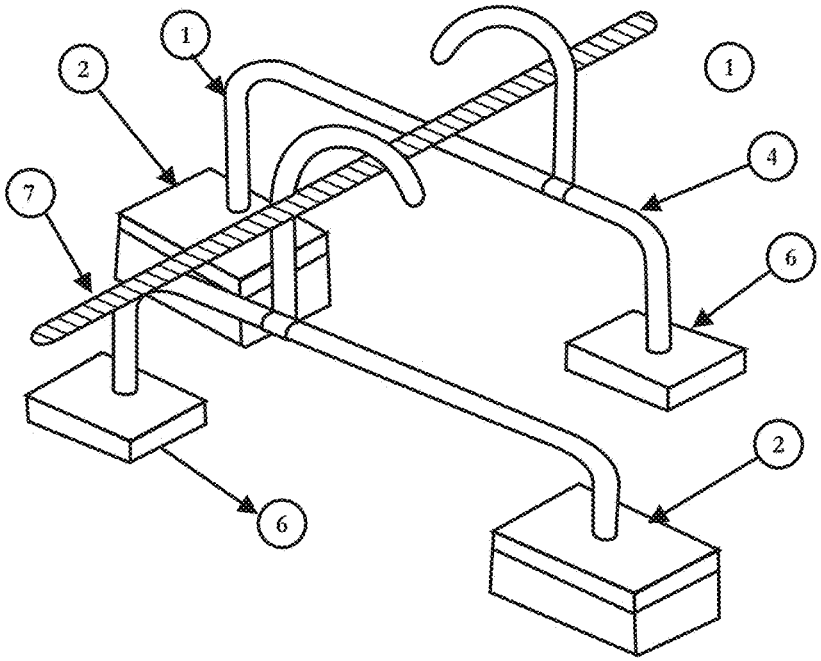

FIG. 3(*e*): Some designs of the structures of Mooring Line Restrainers catering to different mooring line sizes and heights.

FIG. 4(*a*) to

FIG. 4(*d*): The method of positioning the Mooring Line Restrainers around the Mooring Lines.

Figure 5A:
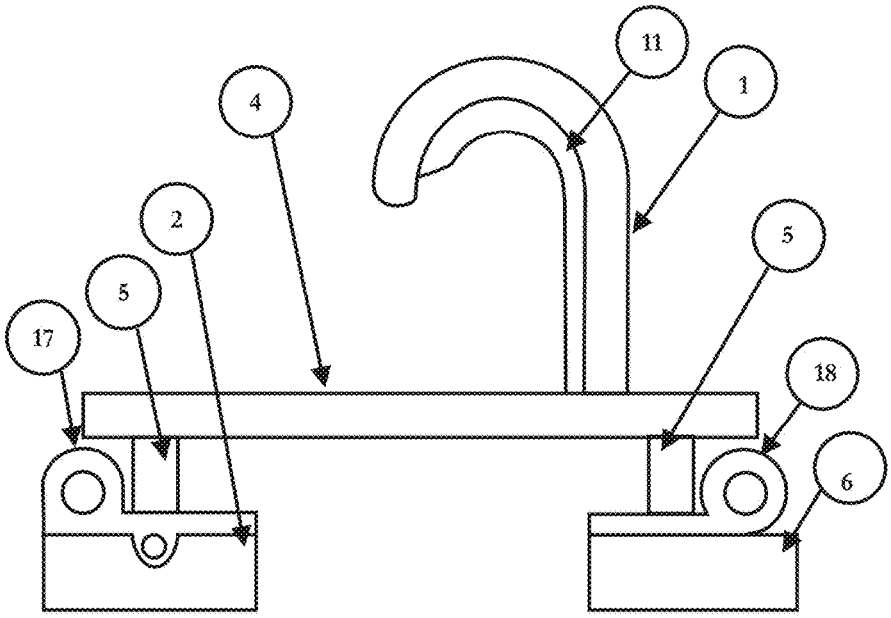
Figure 5B:
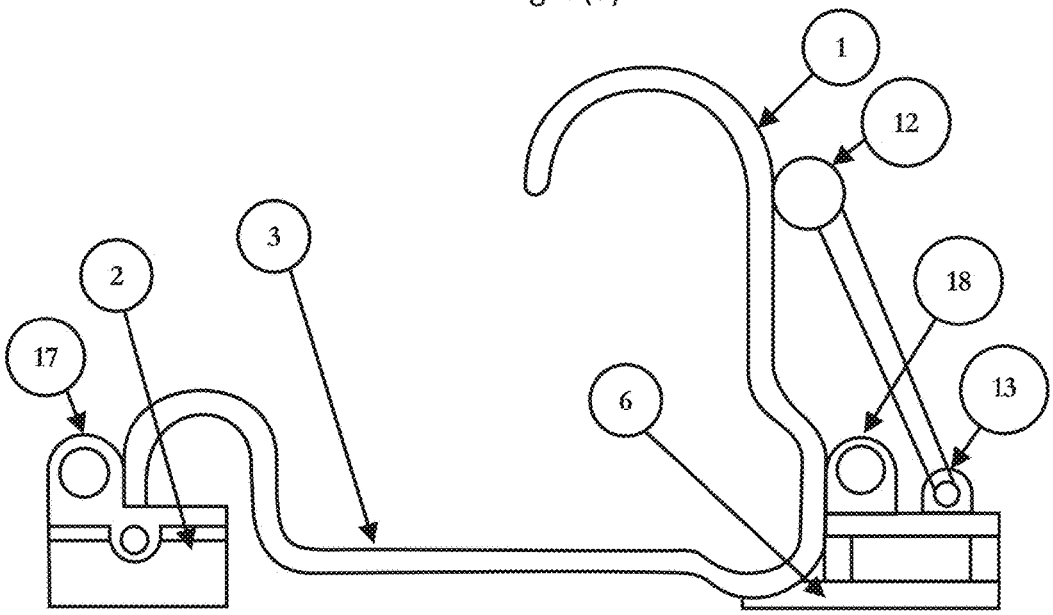
Figure 5C:
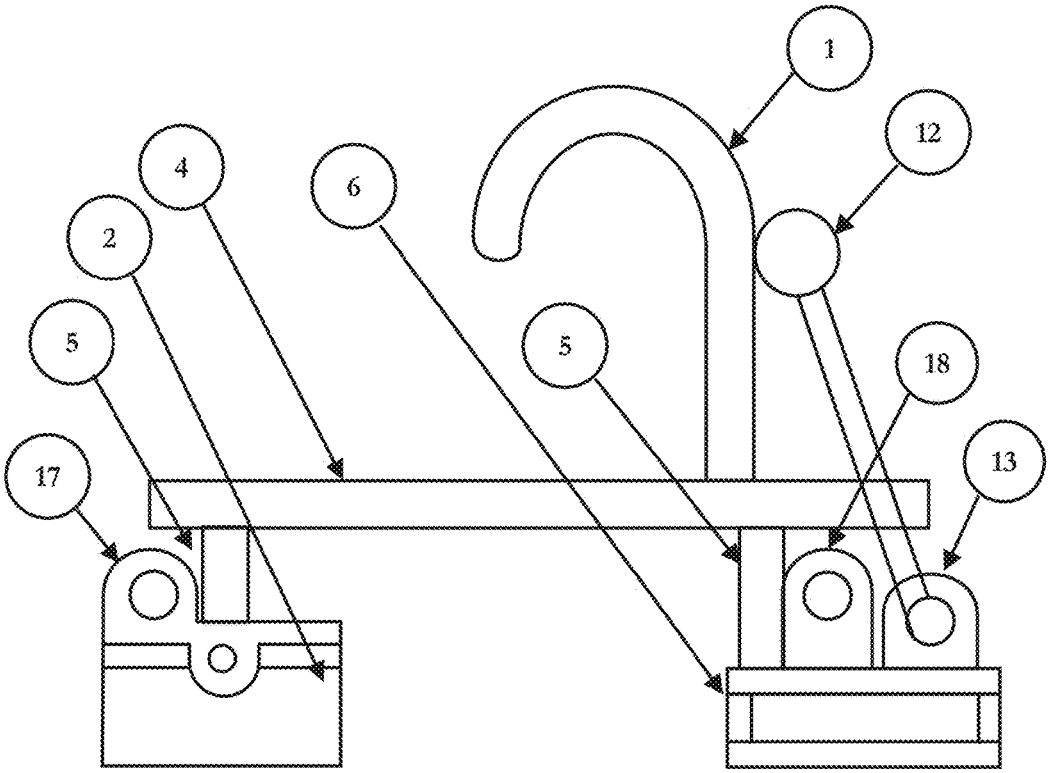
Figure 6A:
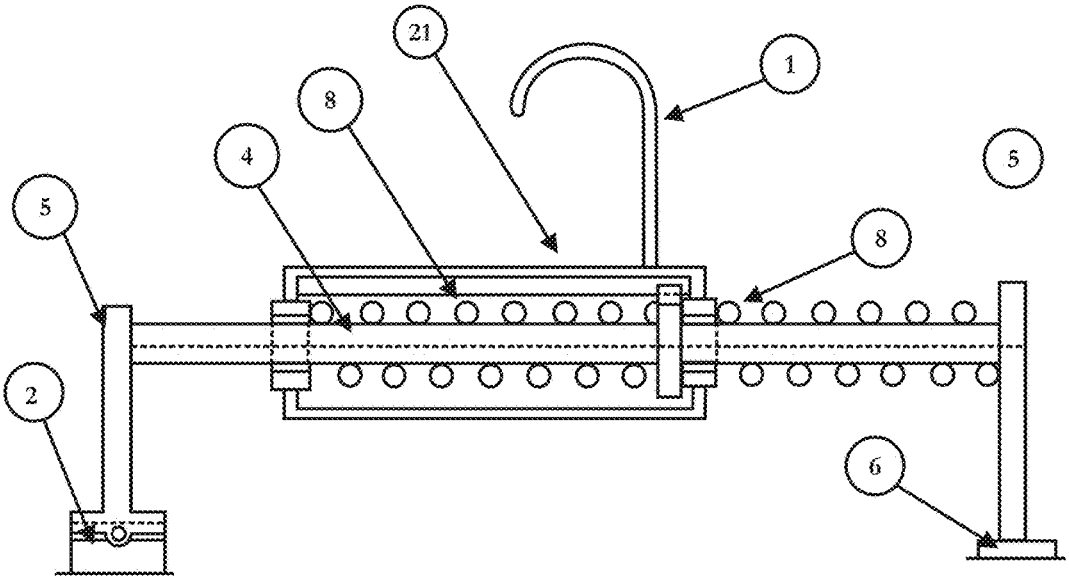
Figure 6B:
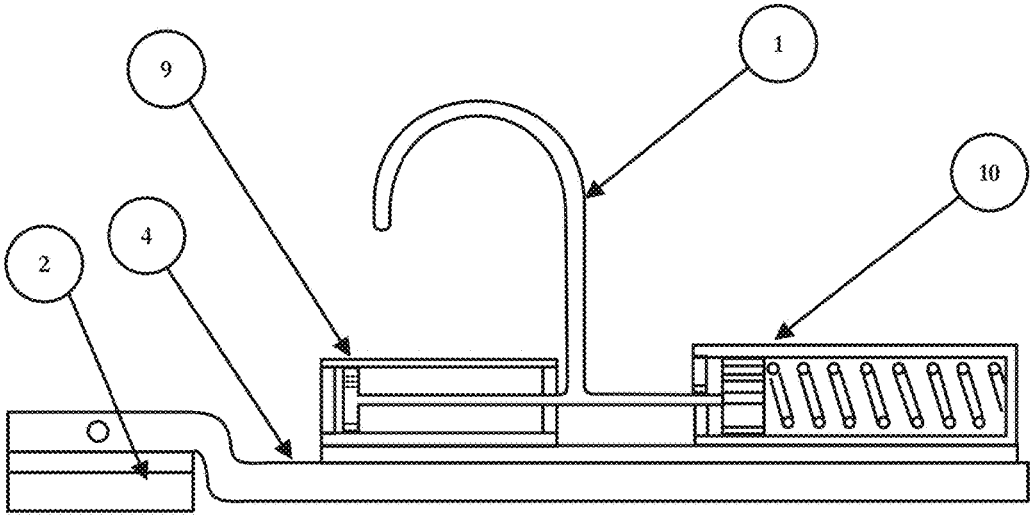
Figure 6C:
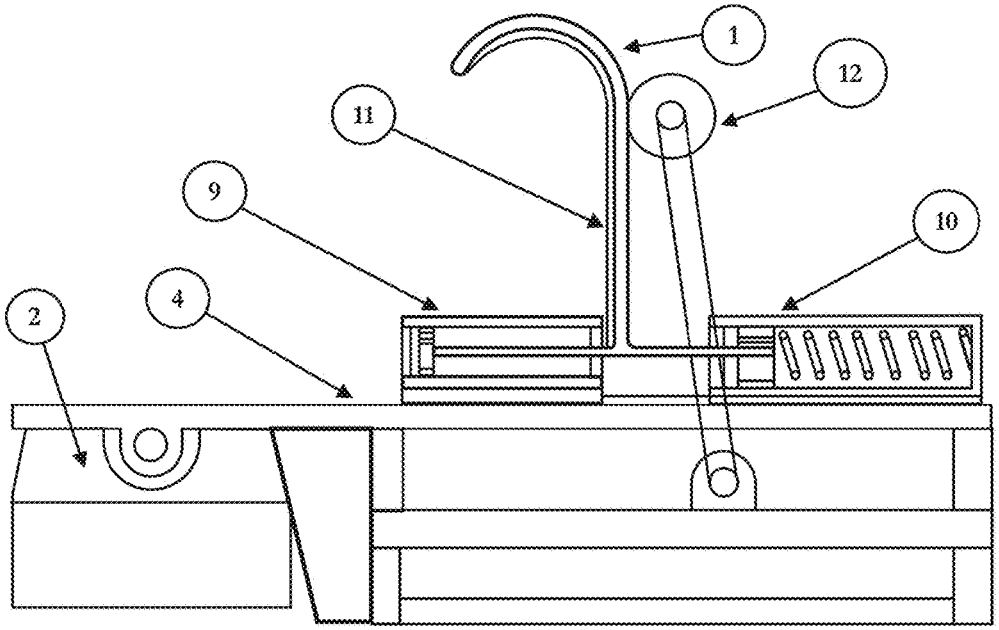
Figure 6D:
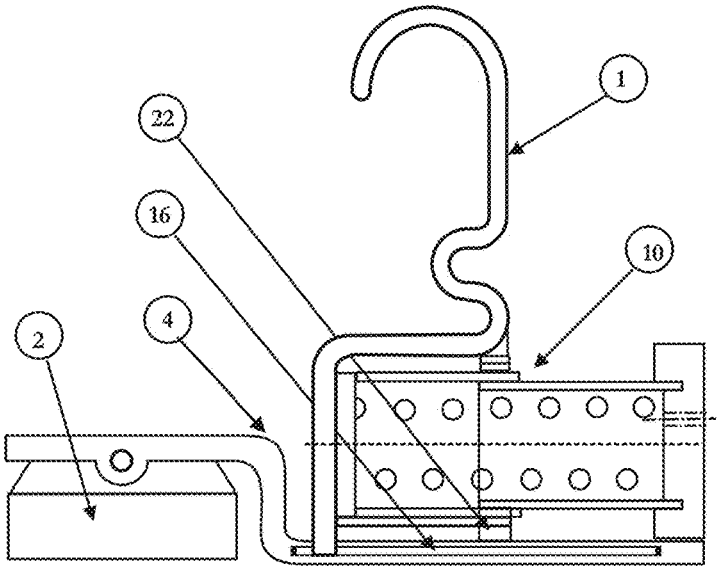
Figure 6E:
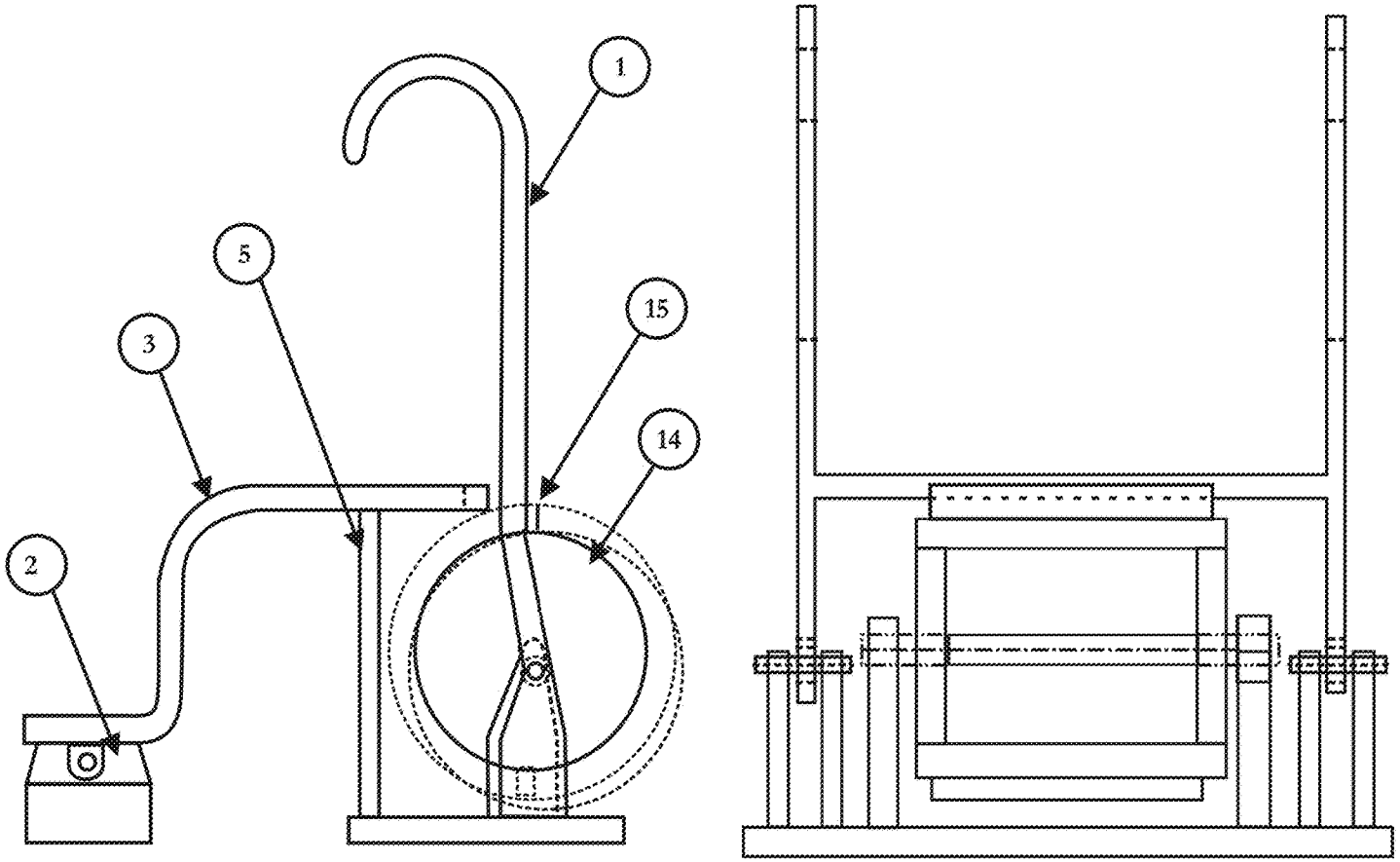

FIG. 5(*a*): An embodiment of a Mooring Line Restrainer incorporating a layer of Energy Absorbing Material.

FIG. 5(*b*) and

FIG. 5(*c*): Embodiments of Mooring Line Restrainer with an Auxiliary Hinged Mass.

FIG. 6(*a*): Another embodiment of a Mooring Line Restrainer with pre-loaded Springs.

FIG. 6(*b*): A Mooring Line Restrainer with a Damper and a Shock Absorber.

FIG. 6(*c*): Another embodiment of a Mooring Line Restrainer with a Spring, a Damper, a Hinged Mass, and a layer of Energy Absorbing Material.

FIG. 6(*d*): Another embodiment of a Flexible Mooring Line Restrainer with a Spring and a Damper.

FIG. 6(*e*): Another embodiment of a Mooring Line Restrainer with an Inertial Energy Absorbing Drum.

While the invention is described in conjunction with the illustrated embodiments, it is understood that it is not intended to limit the invention to such embodiments. On the contrary, it is intended to cover all alternatives, modifications and equivalents may be included within the spirit and scope of the invention disclosure as defined by the claims.

DETAILED DESCRIPTION OF THE INVENTION

At the outset of the description, which follows, it is to be understood that the ensuing description only illustrates a particular form of the invention. However, such a particular form is only an exemplary embodiment and the teachings of the invention are not intended to be taken restrictively.

For the purpose of promoting an understanding of the principles of the invention, reference is now to be made to the embodiments illustrated and the specific language would be used to describe the same. It is nevertheless to be understood that no limitations of the scope of the invention is hereby intended, such alterations and further modifications in the illustrated bag and such further applications of the principles of the invention as illustrated therein being contemplated as would normally occur to one skilled in the art to which the invention relates.

The embodiments are described with reference to the drawings in which like parts are referred to by like numerals. These embodiments are for illustrative purpose only and it should be noted that invention is not limited to the embodiments illustrated in the drawings. Certain details, e.g. manufacturing/assembly details, have been omitted since they are not necessary to understand product functioning.

As used herein and subsequently in the claims, the singular form 'a', 'an', and 'the' includes plural reference unless the context clearly indicates otherwise.

The present invention relates to a structurally shaped device, referred to herein as a mooring line restraining device, for engaging and confining any snapped mooring line within a significantly small area. A modular assembly of these devices capable of being assembled and disassembled and located at or near any desired position around mooring lines on the deck of a ship is proposed. As stated, the mooring line restraining device is designed to confine any snapped mooring line within a well-defined area which is much smaller and narrower than the snap-back zones conventionally suggested in various maritime safety manuals. In its broadest novelty, the mooring line restraining device of the invention is composed of (a) a restraining member of sufficient strength to withstand the whiplash of a snapped line, and (b) a sturdy structural framework for positioning the restraining member at an appropriate height around the mooring line, (c) at least one support being a magnetic holding device for firmly anchoring the restraining member on the deck of a ship, (d) the framework employing mechanical advantage, and (e) means for interlinking for forming an assembly of devices for enhanced safety.

The mooring line restraining device of the present invention is unique, since there has been no earlier attempt for restricting the size of the snap-back zones of mooring lines.

The conventional snap-back zone of a mooring line is shown in FIG. 1 (*a*). This shows the shape of the area considered to be the danger zone, the snap-back zone, indicated in almost every maritime safety manual. As defined in several maritime safety manuals, the snap-back zone covers about ten degrees on either side of the lay of the line, although it is recognized that there is no definite method of accurately ascertaining the extent of these zones.

A typical snap-back zone of a line wrapped around a pedestal is shown in FIG. 1 (*b*). In this case also there is no analytical technique to ascertain the extent of the snap-back zone with certainty.

Generally, it is recommended that snap-back zones be marked on the deck of a ship as indicated in FIG. 1 (*c*). However, in view of the possible changes in the mooring plan/layout, it is not a universal practice.

Since the orientation of the mooring lines can change for a ship according to mooring plan as per conditions and specific needs in different ports, as well as the possibility of the snap-back zones of several lines overlapping, it is impractical to clearly demarcate definite areas on the deck for locating and fixing such devices. Also it is not advisable to permanently fix any such structures on the deck.

The solution to this dilemma is to fabricate these restraining devices as portable structures which can be quickly placed in desired locations along a mooring line and the problem of fixing these to the deck has been solved by mounting the mooring line restraining devices on appropriate supporting means such as magnetic holding devices. In order to be effective, the mooring line restraining devices have to be sufficiently robust to withstand the impact force of a snapped mooring line, and fixed firmly to the deck. The magnetic holding devices facilitate positioning and securing of the restraining devices in appropriate locations as required in each situation. Once these mooring line devices of desired strength are appropriately placed around the mooring lines at regular intervals, any snapped line would remain confined within a small region along its original orientation, thus eliminating or at least reducing, the possibility of mooring operations related injuries to a large extent.

In its basic embodiment, the mooring line restraining device comprises a restraining member (1) for engaging and holding a snapped mooring line and a magnetic holding device (2) as shown in FIG. 3(*a*). The design shown in FIG. 3 (*a*) would be adequate for a mooring line restraining devices of small heights. Preferably, the mooring line restraining device of the invention is capable of being interlinked to other similar devices to ensure greater stability. This is achieved by the provision of interlinking means (17, 18) on the base of the supporting means of the restraining member as shown in FIG. 3 (*aa*). In a particular embodiment, the mooring line restraining devices can be interlinked through rods or pipes passing through the two interlinking means (17, 18) as shown in FIG. 3 (*aa*). However, in this basic embodiment the torque arm of the force of impact of would be much larger than the torque arm of the force of the holding magnet, thus requiring impractically large magnets for preventing toppling of the restrainer. Therefore, development of more practical embodiments has to be based on a two-fold approach:

1. Minimizing the force of impact of a snapped mooring line by using means like Energy Absorbing Materials, Dampers, Shock Absorbers, Energy Sharing Apparatus or combinations of some of these.
2. Selecting a form of the support structure for the restrainer for making the torque arm of the force of the holding magnet larger than that of the toppling force of impact from a snapped mooring line.

The subsequent drawings describe several embodiments to illustrate the application of these principles. It is important to stress that in these embodiments the specific forms of the structures shown are not important, and may take any convenient alternative form as long as these conform to the approach outlined above.

In general, the restraining member is made of a steel rod of appropriate diameter and size, and mounted on a framework made of steel tubes or rods attached to at least one magnetic holding device of holding power commensurate with the size and material of the mooring line.

The structure of the mooring line restraining device could take any convenient form in practice to meet the required strength and resilience for mooring lines of different sizes and materials. The design of the mooring line restraining devices for each class of mooring line would have to be carefully arrived at by considering (a) the material and weight per unit length of the line, and (b) the estimated velocity of a snapped line.

The mooring line restraining device as shown in FIG. 3 (*b*) has a single magnetic holding device (2) on the distal end of the substantially elongate horizontal limb (3) of the restraining member (1) to anchor said member while the near end of the horizontal limb (3) is contoured to constitute a further supporting means. In other embodiments, this further supporting means can be made of a small base plate welded to the substantially vertical member of the restraining member device (1). The mooring line restraining device of FIG. 3 (*b*) can also be provided with interlinking means (17, 18).

Another preferred embodiment of the mooring line restrainer is shown in FIG. 3 (*e*). In this embodiment, a single or multi-turn spring (8) forms an integral part of the restraining member (1), mounted on a horizontal structural member (4). The distal end of the horizontal member (4) is attached to the holding magnet (2), while the near end is attached to a support base (6). The interlinking means (17, 18) are provided on the holding magnet (2) and the support base (6) for interlinking of adjacent or alternate mooring line restrainers.

A stronger structure would be required for a heavier mooring line. A sturdier structure for catering to a higher position of a mooring line during mooring operations or for a heavier line is illustrated in FIG. 3 (*c*). In this embodiment, the base of the restraining member (1) comprises a horizontal planar member (4) which is connected to a pair of supporting means (2, 6) through the medium of respective vertical extensions (5), at least one (2) of the supporting means (2) is magnetic. The substantially vertical member (1) forming part of the restraining member (1) device is shown as extending upward from the horizontal planar member (4). The mooring line device also includes the interlinking means (17, 18).

FIG. 3(*d*) illustrates a Mooring Line Restraining Device wherein the restraining member (1) has a base in the form of a framework formed by structural members (3B, 3C), mounted on three supporting means (2). In this figure all supporting means are shown to be magnetic holding devices, but it is essential to have at least one of these to be magnetic for ensuring the secure anchoring of the device on the deck of a ship in a desired location. Since the framework has multiple supporting means, in some embodiments more than one restraining members can be incorporated, one on each support.

The vertical extensions (5) can be inter-connected with a horizontal cross-piece (4A) for withstanding the force of impact from heavier mooring lines thereby providing greater stability as shown in FIG. 4 (*b*). This figure also shows the position of the restraining member (1) with respect to a mooring line (7).

FIG. 4 (*a*) illustrates another embodiment of the mooring line restraining device of the invention where the base of said restraining member (1) comprises a substantially C-shaped element (3A), the open ends of which are connected to a pair of supporting means (2, 6) at least one (2) of which is magnetic. The interlinking means (17, 18) and the position of the restraining member (1) with respect to a mooring line (7) are also shown.

As will be appreciated, the mooring line restraining device of the invention can incorporate one or more magnetic holding devices of appropriate type, design and strength commensurate with the size and type of the mooring lines. The design of the mooring line restraining device has the flexibility of allowing the choice of one, two or more magnetic holding devices as supporting means as would be required for providing an acceptable degree of safety for the mooring crew for the type and size of the mooring lines in each case. As an example of such a sturdier mooring line device, reference is made to FIG. 3 (*d*) which illustrates a plan view of a mooring line restraining device having two restraining members (1) mounted on a three limbed structure (3B) supported by three magnetic holding devices (2) as the three supporting means. This design can be employed to ensure protection from toppling from the impact of snapping-back of heavier mooring lines.

The use of the magnetic devices for securely and strongly fixing these restraining devices along the mooring lines on the deck of a ship makes the use of the restraining devices very practical. The mooring line restraining devices are capable of being securely installed/dismantled/stored with great speed and ease. This is achieved through on/off mode control of the magnetic holding devices. The secure locking of the magnetic holding devices in the ON position makes the operation foolproof, since one glance at the positions of the locking levers can show if any of the restraining devices has not been secured. Furthermore, these restraining devices can be securely stored in the designated place in a locked position, and would not require any additional means to, prevent them from being thrown around and thus cause danger. The inherent flexibility and simplicity of operation of the mooring line restraining device of the invention enables the mooring crew to quickly install and operate these in an environment of adequate safety.

When a mooring line breaks under great tension it snaps back with very large kinetic energy. Therefore, in order to be able to effectively provide protection in such a situation, the mooring line restraining devices must possess a capability to withstand the force of impact. This can be achieved (a) by absorbing part of the kinetic energy at the time of impact, (b) by minimizing the force of impact and (c) by designing the mooring line restraining devices taking benefit of mechanical advantage by increasing the torque arm of the holding force of the magnet compared to that of the impact force of a snapped line, whereby a smaller holding force can prevent the toppling over of the restrainer from a much larger impact force of the snapped line.

In particular embodiments for greater safety, the vertical member extending upwardly from the base of the restraining member device is provided with cushioning means for minimizing the force of impact from the momentum of a snapped mooring line. Preferably, as described earlier, the cushioning means could include a damping mechanism, a layer of energy absorbing material, a pre-loaded spring, a shock absorber, an auxiliary co-acting counter-weight or inertial mechanism, or a combination of any of these. Absorption of energy can be achieved by incorporating dampers and/or energy absorbing materials. One embodiment of a mooring line restraining device having a layer of energy absorbing material (11) disposed on the impact face of the restraining member (1) is shown in FIG. 5 (*a*). These materials have micro-structures enabling absorption of the bulk of energy of any impacting object, and can greatly reduce the force of impact.

Attaching a suitably hinged auxiliary mass that would detach on impact and take away a part of the energy of the snapped line provides another option for limiting the force of impact on the mooring line restraining devices. Examples of a mooring line restraining devices incorporating an auxiliary hinged mass (12) attached to the support member (6) through the hinge (13) are shown in FIGS. 5 (*b*) and 5 (*c*). When a snapped mooring line impacts the restraining member (1), this mass would move away and would take a share of the energy of the impact, thus reducing the force of impact.

The force of impact due to the momentum of the snapped mooring line would be determined by the rate of change of momentum during the impact. Thus, for minimizing the force on the mooring line restraining devices, the duration of the impact has to be increased. This is achieved by incorporating a degree of flexibility in the mooring line restraining devices. For cases where the impact force is estimated to be small, it can be achieved by the flexibility of the substantially vertical member of the restraining device. However, for heavier lines springs of appropriate strength and flexibility would have to be incorporated. Therefore, in such cases the mooring line restraining devices would have to incorporate a number of different shock or impact absorbing means such as a layer of energy absorbing material, shock absorbing means, an auxiliary co-acting counter-weight or inertial mechanism selected in accordance with the estimated momentum and kinetic energy of the mooring line in each case. Accordingly, the holding power of the magnetic holding devices, the design and strength of the structure, and the various elements employed for minimizing the force of impact of a snapped mooring line would have to be carefully selected.

FIG. 6 (*a*) illustrates an embodiment of a mooring line restraining device in which the restraining member (1) is mounted on a spring loaded frame (21) adapted for free sliding movement along the horizontal structural member (4). The springs (8) by increasing the time/distance of contact of a snapped line with the restraining member (1) reduce the force of impact, thus enhancing the degree of safety.

Another embodiment of a mooring line restraining device incorporating the combination of a damper (9) and a shock absorber (10) is shown in FIG. 6 (*b*). The restraining member (1) is free to slide as shown, and the force of impact of a snapped mooring line on it is kept within limits by the damper (9) and the shock absorber (10). In this embodiment, the horizontal structural member (4) also acts as a base-cum-support means.

The shock absorbers can be of any appropriate size and type. The preferred shock absorbers for use in the invention are mechanical, material, hydraulic, magnetic, or magneto-rheological in that order.

A mooring line restraining device can be provided with a combination of several cushioning means. One such mooring line restraining device incorporating a damper (9), a shock absorber (10), a hinged mass (12), and a layer of energy absorbing material (11) is shown in FIG. 6 (*c*). The restraining member (1) is free to slide, and the impact force of a snapped mooring line is kept within limits by the combined action of all of these cushioning means.

An example of a mooring line restraining device incorporating a flexible restraining member (1) is shown in FIG. 6 (*d*). In this figure, a flexible restraining member (1) is mounted on a frame (22) free to slide in slots (16) provided on an appropriately contoured structural member (4). The impact force is kept within limits by the action of the shock absorber (10) and the flexibility of the restraining member (1). The structural member (4) also functions as the base-cum-support means. The mooring line restraining device is fixed and held in a desired position on the deck of the ship by the magnetic holding device (2).

FIG. 6 (*e*) illustrates a specific embodiment of a mooring line restraining device provided with a pair of vertically extending restraining members (1) spaced apart by a horizontal bar (20) connecting the two restraining members. Situated in proximity to said restraining device and within the space defined by the two vertical restraining members (1) is a drum (14) mounted on and freely rotatable about a horizontal axis, the outer circumference of said drum (14) being provided with an engaging device or tooth (15). When a mooring line snaps and engages the pair of restraining members (1), the members (1) and the horizontal bar (20) connecting them fall back to impinge on the drum (14), the tooth (15) on the surface of which engages the bar (20) while the members fall clear. The drum will continue to rotate till the energy transferred to it is dissipated.

In order to reduce the effective size of the snap-back zones, the mooring line restraining devices of the invention are arranged strategically on the deck of a ship along the path of a mooring line. In practice, the mooring line restraining devices of the invention are placed alternately on either side of the mooring lines on the deck of a ship (FIG. 4 (*d*)) and interlinked. Such an assembly of the mooring line restraining devices of the invention would confine any snapped mooring line within a narrow region in the vicinity of the pre-snap orientation of the mooring line during mooring operations on a ship thus greatly reduce the danger to the mooring crew.

The mooring line restraining devices disposed around the mooring lines are provided means to be interlinked. An array comprising a series of mooring line restraining devices of the invention placed alternately on either side of a mooring line (7) and interlinked by linking means (19) is shown in FIG. 4 (*c*). The preferred linking means comprises rods and pipes which link the supporting means (2, 6) of the adjacent or alternate (2, 2) mooring line restraining devices. Such interconnected array of mooring line restraining devices of the invention forms a very strong barrier capable of confining a snapped mooring line within a narrow region thereby restricting the extent of the danger area.

The speed of installation and dismantling the mooring line restraining devices is of vital importance in mooring operations. Accordingly, the mooring line restraining devices to be placed on either side of the mooring line have a symmetrical configuration and thus are identical. This feature of the design of the mooring line restraining devices of the proposed invention ensures that there is no distinction between the restraining devices to be placed on either side of the mooring lines, thus eliminating any possibility of mix-up or confusion while deploying these on the deck of a ship, or while storing them.

For mooring lines in the vicinity of the bitts or pedestals etc., mooring line restraining devices incorporating magnetic holding devices of larger holding strength would be required. These would only come into play in situations when the lines either jump/slip off these fixtures, or in case of their failure, thus providing additional safety.

The mooring line restraining devices of the present invention are the first and only one means of its kind proposed for enhancing safety of mooring operations. By providing a structural means to be positioned along a mooring line, these devices constitute a giant leap forward in greatly reducing the danger to the mooring crew from the whiplash of any snapped mooring line by confining such lines within a narrow well-defined region. These devices are portable so that they can be positioned around the mooring line as required in any situation. Furthermore, these devices are capable of being fixed firmly to the deck of a ship in the desired locations.

In preferred embodiments, the mooring line restraining device of the invention can additionally incorporate one or more cushioning means for softening the force of impact of a snapped mooring line. Such device are also provided with interlinking means for interlinking with similar devices.

The mooring line restraining devices of the present invention can be periodically tested for their efficacy on the ship itself by the ship's personnel without any additional training or requiring any specialized tools, instruments, or equipment. They have a long life and require minimal maintenance. They are capable of efficient functioning in different climatic conditions, unaffected by storm, wind, heat, rain, or snow.

Installation of the mooring line restraining devices along the mooring lines as described above would effectively reduce the danger to the crew of a ship from the majority of serious mooring line related accidents on ships. The recommended number of the mooring line restraining devices, and their required holding strength for any ship would depend on the relevant data like the number, height, material, type, size and location of mooring lines.

All documents cited in the description are incorporated herein by reference. The present invention is not to be limited in scope by the specific embodiments and examples which are intended as illustration of a number of aspects of the scope of this invention. Those skilled in the art will know or to be able to ascertain using no more than routine experimentation many equivalents to the specific embodiments of the invention described herein.

It is to be noted that the present invention is susceptible to modifications, adaptations and changes by those skilled in the art. Such variant embodiments employing the concepts and features of this invention are intended to be within the scope of the present invention, which will be further set forth under the claims.

We claim:

1. A Mooring Line Restrainer, capable of withstanding whiplash from an impact of a snapped mooring line, the Restrainer comprising: a contoured Restraining Member shaped to engage and restrain a snapped mooring line; and a single or multi-turn spring, mounted on a framework attached to one or more support bases, wherein at least one of the support bases comprises a magnetic holding device with sufficient holding strength for fixing Mooring Line Restrainers on a deck of a ship at appropriate positions along and on either side of each of the mooring lines arranged as per a mooring layout plan, and wherein said support bases comprise structures for interlinking a set of adjacent or alternate Mooring Line Restrainers to form strong structures around the mooring lines for confining and restraining any snapped mooring lines within narrow zones around pre-snapped positions of those mooring lines on the ship's deck, thereby substantially reducing their effective snap-back zones and increasing a safe working area on the ship's deck during mooring and towing operations.

2. The Mooring Line Restrainer of claim 1, further comprising one or more single or multi-turn springs, shock absorbers, dampers, or hinged counterweights for minimizing an impact force on the Restrainer from the snapped mooring lines.

3. The Mooring Line Restrainer of claim 1, wherein said contoured Restraining Member comprises a substantially vertical section extending upwardly from the framework attached to the magnetic holding device of the support base and terminating in a curved or hooked end for engaging and restraining said snapped mooring lines.

4. The Mooring Line Restrainer of claim 1, wherein said Restrainer and the framework comprise one or more of metals, alloy-metals, and composite materials, fabricated by employing one or more of welding, casting, die-casting, and forging, and wherein the Restrainer is capable of withstanding impact of whip-lash of the snapped mooring lines.

5. The Mooring Line Restrainer of claim 1, wherein the framework of said Restrainer makes holding torques of the magnetic holding device greater than torques of forces of impact from the snapped mooring lines, and wherein the Restrainer is capable of restraining mooring lines of variable heights laid on the ship's deck according to the mooring layout plan.

6. The Mooring Line Restrainer of claim 2, wherein said Restrainer and the framework comprise one or more of metals, alloy-metals, and composite materials, fabricated by employing one or more of welding, casting, die-casting, and forging, and wherein the Restrainer is capable of withstanding impact of whip-lash of the snapped mooring lines.

7. The Mooring Line Restrainer of claim 3, wherein said Restrainer and the framework comprise one or more of metals, alloy-metals, and composite materials, fabricated by employing one or more of welding, casting, die-casting, and forging, and wherein the Restrainer is capable of withstanding impact of whip-lash of the snapped mooring lines.

8. The Mooring Line Restrainer of claim 2, wherein the framework of said Restrainer makes holding torques of the magnetic holding device greater than torques of forces of impact from the snapped mooring lines, and wherein the Restrainer is capable of restraining mooring lines of variable heights laid according to the mooring layout plan.

9. The Mooring Line Restrainer of claim 3, wherein the framework of said Restrainer makes holding torques of the magnetic holding device greater than torques of forces of impact from the snapped mooring lines, and wherein the Restrainer is capable of restraining mooring lines of variable heights laid according to the mooring layout plan.

10. The Mooring Line Restrainer of claim 1, wherein the Restraining Member comprises a layer of Energy Absorbing Material for minimizing an impact force on the Restrainer from the snapped mooring line.

* * * * *